US005664551A

United States Patent [19]

Spector

[11] Patent Number: 5,664,551

[45] Date of Patent: Sep. 9, 1997

[54] TOY ROCKET AND LAUNCHER ASSEMBLY

[76] Inventor: Donald Spector, 380 Mountain Rd., Union City, N.J. 07080

[21] Appl. No.: 715,925

[22] Filed: Sep. 20, 1996

[51] Int. Cl.[6] ..... F41B 7/00

[52] U.S. Cl. ..... 124/16

[58] Field of Search ..... 124/16, 26, 36, 124/37

[56] References Cited

U.S. PATENT DOCUMENTS

| | | | |
|---|---|---|---|
| 3,088,450 | 5/1963 | Clay | 124/26 |
| 3,191,342 | 6/1965 | Chalmers | 124/16 X |
| 3,635,204 | 1/1972 | Plumb | 124/16 |
| 3,792,861 | 2/1974 | Coleman | 124/16 X |
| 3,856,300 | 12/1974 | Payne | 124/16 |
| 3,949,518 | 4/1976 | Lenza | 124/16 X |

*Primary Examiner*—John A. Ricci
*Attorney, Agent, or Firm*—Michael Ebert

[57] ABSTRACT

A two-stage toy rocket and spring-loaded launcher assembly which when fired, propels the first stage into space. The first stage of the rocket is a missile molded of resilient plastic material having a solid disc mounted on its rear end encircled by a coupling collar. The second stage is formed by an externally-threaded sleeve whose upper end is received in the rear end collar of the first stage, and is releasable therefrom by a release button which, when actuated, then decouples the first stage from the second stage. The launcher is formed by a platform on which is anchored an internally-threaded shell whose diameter is such that it is threadably receivable in the sleeve of the second stage, a spring being nested in the shell and projecting thereabove. When a player turns the rocket to cause the threaded sleeve of the second stage to advance into the threaded shell of the launcher and thereby compress the spring then interposed between the disc at the rear end of the first stage and the platform, this action develops a strong latent force to cock the toy rocket. To fire the toy rocket, the player actuates the release button to decouple the first stage from the second stage, thereby causing the released spring to apply a powerful thrust force to propel the first stage into space.

5 Claims, 2 Drawing Sheets

TOY ROCKET AND LAUNCHER ASSEMBLY

BACKGROUND OF INVENTION

1. Field of Invention

This invention relates generally to toy rockets, and more particularly to a two-stage toy rocket and spring-loaded launcher assembly adapted to propel the first stage of the rocket into space.

2. Status of Prior Art

A conventional rocket is a vehicle propelled by the ejection of gases resulting from the combustion of self-contained propellants. The force acting on a rocket to propel it into space is referred to as the thrust force. The first rocket is believed to have been invented by the Chinese as early as 1000 A.D., this being formed by bamboo tubing having gun powder stuffed therein.

The major figure in American rocket development is Robert Goddard who in 1926 launched the first liquid fueled rocket. Although early forms of rockets had only one stage, it was later recognized that a single stage rocket was incapable of reaching the Earth's escape velocity. This led to the development of multi-stage rockets, such as the two-stage Atlas and the three stage Centaur capable of exploring outer space. In a multiple stage rocket, two or more rockets are assembled in tandem. These are ignited in turn, so that when the fuel in the lowermost stage is exhausted, it is then detached and falls back to Earth while the fueled next stage continues its flight.

Because children have always been fascinated by rockets, attempts were made to provide children with toy rockets. Early forms of toy rockets used a gas propellant produced by mixing water with reactive chemicals. By reason of the chemicals involved, these toy rockets were not hazard-free and such rockets were withdrawn from the market.

In order to avoid the use of gas propellants, toy rockets were later developed making use of a spring which when compressed and then released applied a thrust force to the rocket. But spring-loaded launchers for toy rockets afforded relatively weak thrust forces. The reason for this is that the physical strength demanded to adequately compress a heavy spring and thereby produce a powerful thrust force is a strength lacking in most children.

If therefore a child is provided with a spring-loaded launcher for a toy rocket and is required to compress this spring by directly applying pressure thereto, he may be unable to adequately compress this spring to produce a strong thrust force when the spring is released. The toy rocket is therefore unable to fly more than a short distance, and its performance is unimpressive.

SUMMARY OF INVENTION

In view of the foregoing, the main object of this invention is to provide a two-stage toy rocket and launcher assembly which includes a compressible spring to propel the first rocket stage into space.

More particularly an object of this invention is to provide an assembly of the above type in which a strong helical spring is highly compressed by the player without the need to exert great physical effort to do so.

A significant feature of the invention is that the helical spring is nested in an internally-threaded shell anchored on a launching platform, the spring being compressed by means of an externally-threaded sleeve that is turned into the shell by the player. Since it takes several turns of the sleeve to effect an incremental compression of the spring, this screw-like vernier action affords a mechanical advantage making it possible to fully compress the spring without exerting a greater physical effort than a child is capable of expending.

Also an object of this invention is to provide a two-stage rocket and launcher assembly that is hazard-free, simple for a child to operate, and inexpensive to manufacture.

Briefly stated, these objects are attained by a two-stage toy rocket and launcher assembly which when fired, propels the first stage into space. The first stage is a missile molded of soft plastic having a solid disc mounted on its rear end encircled by a coupling collar. The second stage is formed by an externally-threaded sleeve whose upper end is received in the collar at the rear of the first stage, and is releasable therefrom by a release button which when actuated then decouples the first stage from the second stage.

The launcher is formed by a platform on which is anchored an internally-threaded shell whose diameter is such that it is threadably receivable in the sleeve of the second stage, a spring being nested in the shell and projecting therefrom. When the player turns the rocket to cause the threaded sleeve of the launcher of the second stage to advance into the threaded shell and thereby compress the spring then interposed between the disc at the rear end of the first stage and the platform, this action develops a strong latent force to cock the toy rocket. To fire the toy rocket, the player actuates the release button to decouple the first stage from the second stage, causing the released spring to apply a powerful thrust force to propel the first stage into space.

BRIEF DESCRIPTION OF DRAWING

For a better understanding of the invention, as well as other objects and further features thereof, reference is made to the allowing detailed description to be read in conjunctions with the accompanying drawings, wherein:

FIG. 2 is a bottom view of the first stage;

DESCRIPTION OF INVENTION

Figure 1:
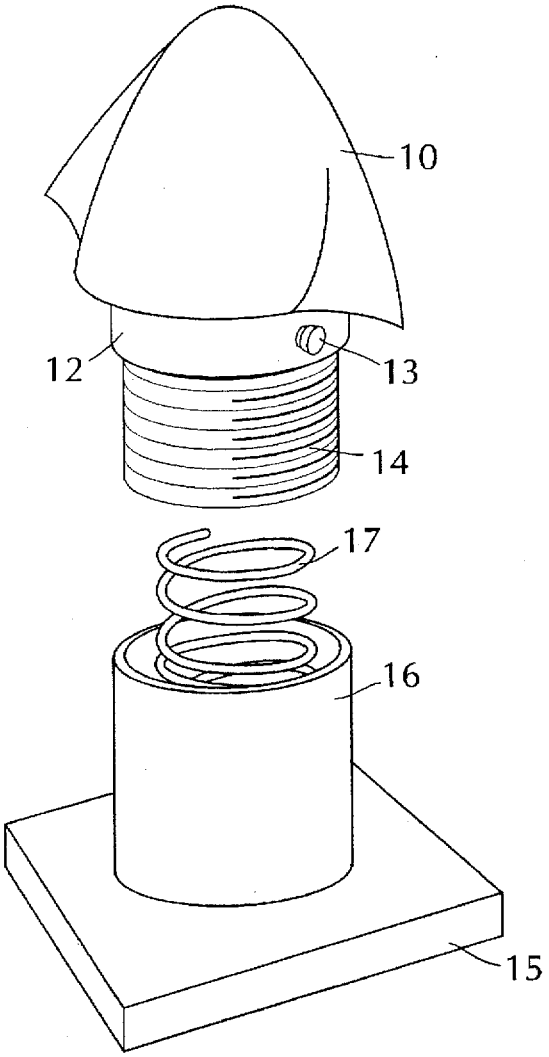
FIG. 1 is a perspective view of a two stage toy rocket and launcher assembly, the rocket being shown as being separated from the launcher.
Figure 2:
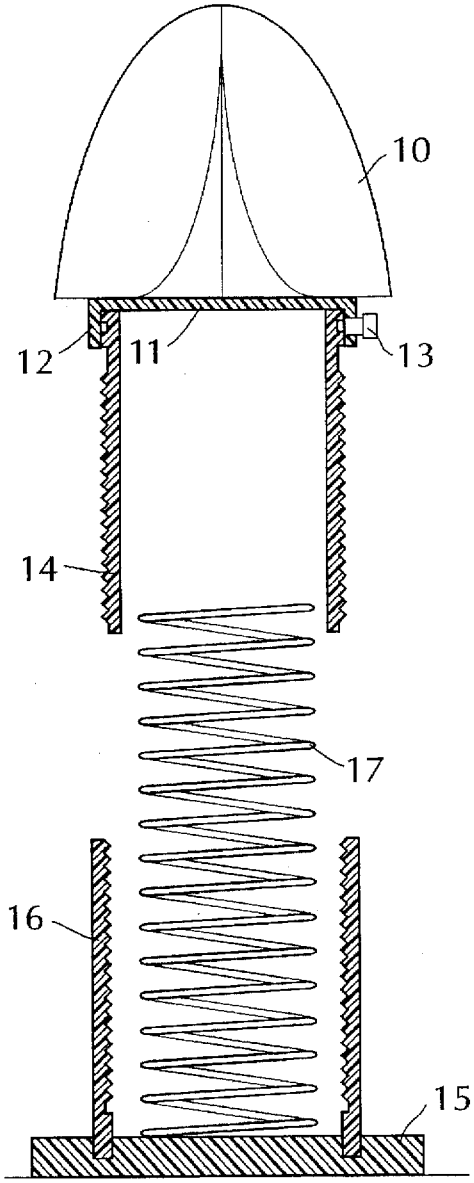
FIG. 2 is a sectional view of the assembly shown in FIG. 1.
Figure 3:
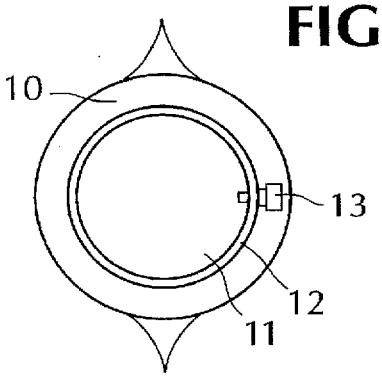

Referring now to FIGS. 1 and 2, it will be seen that a two-stage toy rocket and launcher assembly in accordance with the invention includes a first rocket stage 10 shaped like a missile having stabilizer fins molded of flexible urethane foam or other soft and resilient synthetic plastic material. It is desireable that the toy missile be soft, for it is strongly propelled and should it strike an object such as a window, or a child, it would not then inflict any harm or damage.

Centrally mounted on the flat rear end of missile 10 is a rigid plastic or metal disc 11 encircled by a circular coupling collar 12 which projects from the rear end. Collar 12 is provided with a release button 13 whose function will later be described.

The second stage of the rocket is formed by an externally-threaded cylindrical sleeve 14 of plastic or metal whose diameter is such that its upper end telescopes neatly within collar 12 at the rear end of the first stage and is locked thereto by release button 13.

Release button 13 is shown schematically, for it can take various forms. In a practical embodiment, release button 13 is provided with a spring-biased pin that goes through a bore in the wall of collar 12 to enter a circumferential groove in the upper end of sleeve 14, thereby locking the sleeve to the collar. When release button 13 is actuated, its pin is then retracted to decouple sleeve 14 from collar 12, thereby separating the second stage of the rocket from the first stage.

The launcher is formed by a rectangular platform 15 on which is anchored an internally-threaded shell 16 whose longitudinal axis is normal to the horizontal face of the platfrom so that the shell is upright. Nested concentrically within shell 16 is a cylindrical helical compression spring 17 formed of round metal or plastic wire, the upper end of the compression spring normally projecting above the upper end of the shell.

Regardless of its form, a spring is adapted to store energy as a function of displacement. A force applied to a spring member will displace it to an extent that depends on the magnitude of the force, thereby absorbing energy.

In a helical compression spring, when a force is applied to compress the spring, the amount of stored energy and the resultant latent force depends on the degree to which the spring is shortened. The maximum latent force is produced when the spring is fully compressed. But with a heavy helical spring, should compression be effected by directly applying a physical force to the spring, to fully compress the spring would require a physical force which a child and even many adults is incapable of producing.

Figure 4:
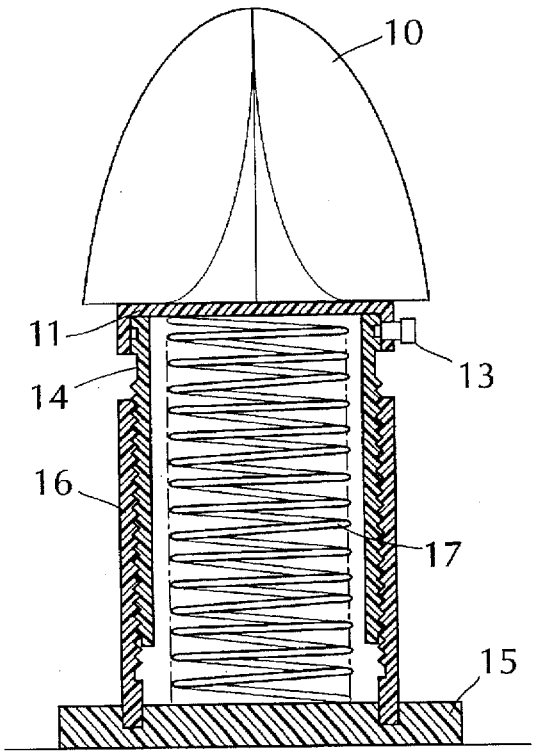
FIG. 4 illustrates the assembly in its cocked state in which the second stage of the rocket is screwed into the shell of the launcher to compress a spring nested in the shell.

To operate an assembly in accordance with the invention, the two-stage rocket is grasped by a child who screws the externally-threaded sleeve 14 of the second stage into the internally-threaded shell 16 of the launcher, as shown in FIG. 4. As sleeve 14 is being turned into shell 16, helical spring 17, then interposed between disc 11 on the rear end of missile 10 (first stage) and the face of platform 15 is subjected to compression. Each turn of sleeve 14 acts to apply pressure to slightly shorten the distance between disc 11 and the face of platform 15.

Hence it takes several turns of sleeve 14 to produce a significant incremental compression of the spring. In mechanical terms, it takes movement of the sleeve in a long helical path to effect a small deflection of the spring. The resultant mechanical advantage makes it possible for a child to screw sleeve 14 into shell 15 with relatively little effort, and in doing so to fully compress helical spring 17 and thereby develop a strong latent force which becomes a kinetic or thrust force when the compressed spring is released.

Figure 5:
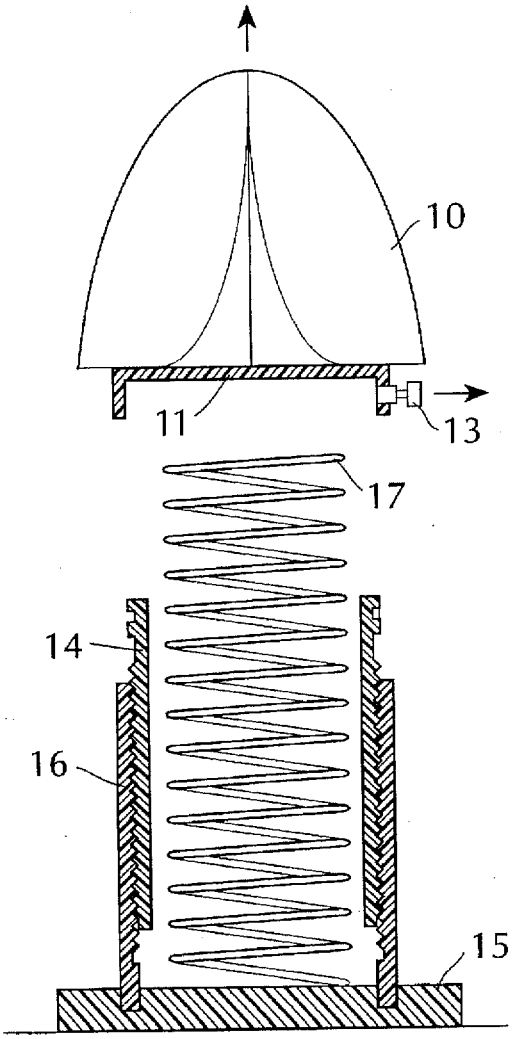
FIG. 5 shows the assembly after it has been fired, the first stage of the rocket then being propelled into space while the second stage remains behind in the launcher.

In the state of the assembly shown in FIG. 4, the assembly is said to be cocked, for the confined helical spring is fully compressed, and the assembly is in condition to be fired. To fire the assembly, release button 13 is actuated by the player to decouple the first stage of the rocket (missile 10) from the second stage (sleeve 14), as shown in FIG. 5.

As a consequence, the released spring 17 immediately expands against disc 11 at the rear end of the first stage and applies a powerful thrust force thereto which propels the first stage upwardly into space a long distance.

The second stage (sleeve 14) remains screwed into shell 16 of the launcher. Hence when missile 10 is later recovered and the child wishes to again launch the missile, sleeve 14 must be unscrewed from shell 16 and recoupled to collar 12 at the rear of the missile.

In the arrangement shown, the platform of the launcher lies on a horizontal surface and the missile is therefore launched upwardly in a vertical path. In practice, a launching platform may be provided having an adjustable angle so as to launch the missile in an inclined path toward a target.

While there has been shown a preferred embodiment of the invention, it is to be understood that many changes may be made thereon within the spirit of the invention.

I claim:

1. A two stage toy rocket and launcher assembly comprising:

A. a first stage shaped like a missile having a flat rear end on which is mounted a disc encircled by a coupling collar projecting from the rear end provided with release means;

B. a second stage formed by an externally-threaded sleeve whose upper end is telescoped into said collar and is normally locked thereto by said release means; and C. a launcher formed by a platform on which is anchored an internally-threaded shell dimensioned to threadably receive said sleeve, and a helical compression spring nested in said shell and projecting thereabove whereby when a player holding said two-stage rocket screws the sleeve into said shell to subject the helical spring to compression between the disc and the platform, the spring then develops a latent force, and when the release means is actuated to decouple the collar of the first stage from the sleeve of the second stage, the released spring imposes a powerful thrust force against the disc to propel the first stage into space.

2. An assembly as set forth in claim 1, in which the missile is formed of resilient material.

3. An assembly as set forth in claim 2, in which the material is a flexible foam plastic.

4. An assembly as set forth in claim 1, in which the helical spring is formed of a round wire.

5. An assembly as set forth in claim 1, in which the release means is a button having a pin which goes through a bore in the wall of the collar to enter a circumferential groove in the sleeve to lock the sleeve to the collar, the sleeve being decoupled when the pin is retracted.

* * * * *